US005485581A

United States Patent [19]

Miyano et al.

[11] Patent Number: 5,485,581

[45] Date of Patent: Jan. 16, 1996

[54] SPEECH CODING METHOD AND SYSTEM

[75] Inventors: Toshiki Miyano; Kazunori Ozawa, both of Tokyo, Japan

[73] Assignee: NEC Corporation, Japan

[21] Appl. No.: 841,827

[22] Filed: Feb. 26, 1992

[30] Foreign Application Priority Data

Feb. 26, 1991 [JP] Japan ..... 3-103263

[51] Int. Cl.[6] ..... G10L 9/16; G10L 9/14; G10L 9/08

[52] U.S. Cl. ..... 395/2.32; 395/2.26; 395/2.27; 395/2.34; 395/2.13

[58] Field of Search ..... 381/40, 36; 395/2.28, 395/2.32, 2.29–2.31, 2.26, 2.27, 2.34, 2.13

[56] References Cited

U.S. PATENT DOCUMENTS 4,945,567 7/1990 Ozawa ..... 381/36

4,980,916 12/1990 Zinser ..... 381/36

5,208,862 5/1993 Ozawa ..... 381/40

*Primary Examiner*—David D. Knepper

*Attorney, Agent, or Firm*—Ostrolenk, Faber, Gerb & Soffen

[57] ABSTRACT

A speech coding method which can code a speech. An autocorrelation of a synthesis signal synthesized from a codevector of an excitation codebook and a linear predictive parameter of an input speech signal is corrected using an autocorrelation of a synthesis signal synthesized from a codevector of an adaptive codebook and the linear predictive parameter and a cross-correlation between the synthesis signal of the codevector of the adaptive codebook and the synthesis signal of the codevector of the excitation codebook. A gain codebook is searched using the corrected autocorrelation and a cross-correlation between a signal obtained by subtraction of the synthesis signal of the codevector of the adaptive codebook from the input speech signal and the synthesis signal of the codevector of the excitation codebook.

2 Claims, 5 Drawing Sheets

SPEECH CODING METHOD AND SYSTEM

BACKGROUND OF THE INVENTION

1. Field of the Invention

This invention relates to a speech coding method and system for coding a speech signal with high quality by a comparatively small amount of calculations at a low bit rate, specifically, at about 8 kb/s or less.

2. Description of the Background Art

CELP speech coding is a known method of coding a speech signal with high efficiency at a bit rate of 8 kb/s or less. Such CELP method employs a linear predictive analyzer representing a short-term correlation of a speech signal, an adaptive codebook representing a long-term prediction of a speech signal, an excitation codebook representing an excitation signal, and a gain codebook representing gains of the adaptive codebook and excitation codebook.

It is already known that, with such CELP method, a better excitation codevector can be searched out to achieve an improved sound quality by using, when the excitation codebook is to be searched, simultaneous optimal gains as the gain of the adaptive codevector and the gain of the excitation codevector. Such speech coding method which uses, when the excitation codebook is to be searched, simultaneous optimal gains as the gain of the adaptive codevector and the gain of the excitation codevector is disclosed, for example, in Ira A. Gerson and Mark A. Jasiuk, "VECTOR SUM EXCITED LINEAR PREDICTION (VSELP) SPEECH CODING AT 8 KBPS", Proc. ICASSP, '90 S9.3, pp.461–464, 1990 (reference 1) and in M. Tomohiko and M. Johnson, "Pitch Orthogonal CELP Speech Coder", Lecture Thesis Collection I of '90 Autumnal Research Publication Meeting, Acoustical Society of Japan, pp.189–190, 1990 (reference 2).

Meanwhile, as a speech coding method which codes a speech signal with high efficiency at a bit rate of 8 kb/s or less, the CELP method which employs a linear predictive analyzer representing a short-term correlation of a speech signal, an adaptive codebook representing a long-term prediction of a speed signal, an excitation codebook representing an excitation signal and a gain codebook representing gains of the adaptive codebook and excitation codebook as described hereinabove is disclosed in Manfred R. Schroeder and Bishnu S. Atal, "CODE-EXCITED LINEAR PREDICTION (CELP): HIGH-QUALITY SPEECH AT VERY LOW BIT RATES", Proc. ICASSP, pp.937–940, 1985 (reference 3).

According to the conventional speech coding methods disclosed in reference 1 and reference 2, the excitation codebook has a specific algebraic structure, and consequently, simultaneous optimal gains of the adaptive codevector and excitation codevector can be calculated by a comparatively small amount of calculation. However, an excitation codebook which does not have such specific algebraic structure has a drawback that a great amount of calculation is required for the calculation of simultaneous optimal gains.

Meanwhile, according to the conventional speech coding method disclosed in reference 3, gains are not normalized, and consequently, the variety of gains is great, which makes the quantization characteristic of the speech coding system low.

SUMMARY OF THE INVENTION

It is an object of the present invention to provide a speech coding system which can code a speech signal at a bit rate of 8 kb/s or less by a comparatively small amount of calculations to obtain good sound quality.

In order to attain the object, according to an aspect of the present invention, there is provided a speech coding method for coding an input speech signal using a linear predictive analyzer for receiving such input speech signal divided into frames of a fixed interval and finding a linear predictive parameter of the input speech signal, an adaptive codebook which makes use of a long-term correlation of the input speech signal, an excitation codebook representing an excitation signal of the input speech signal, and a gain codebook for quantizing a gain of the adaptive codebook and a gain of the excitation codebook, which method comprises at least the steps of:

correcting an autocorrelation of a synthesis signal synthesized from a codevector of the excitation codebook and the linear predictive parameter using an autocorrelation of a synthesis signal synthesized from a codevector of the adaptive codebook and the linear predictive parameter and a cross-correlation between the synthesis signal of the codevector of the adaptive codebook and the synthesis signal of the codevector of the excitation codebook; and searching the gain codebook using the corrected autocorrelation and a cross-correlation between a signal obtained by subtraction of the synthesis signal of the codevector of the adaptive codebook from the input speech signal and the synthesis signal of the codevector of the excitation codebook.

In the speech coding method, the adaptive codebook is searched for an adaptive codevector which minimizes the following error C:

$$C=\sum_{n=0}^{N-1}\{xw'(n)-\beta Sa_d(n)\}^2 \tag{1}$$

for $$\beta=\langle xw', Sa_d\rangle/\langle xw', xw\rangle \tag{2}$$

where xw' is a signal obtained by subtraction of an influence signal from an input perceptually weighted signal, $Sa_d$ is a perceptually weighted synthesized signal of an adaptive codevector $a_d$ of a delay d, $\beta$ is an optimal gain of the adaptive codevector, N is a length of a subframe, and <*, *> is an inner product.

Subsequently, the excitation codebook is searched for an excitation codevector which minimizes, for the selected adaptive codevector $a_d$, the following error D:

$$D=\sum_{n=0}^{N-1}\{xa(n)-\gamma Sc_i'(n)\}^2 \tag{3}$$

for $$\gamma=\langle xa, Sc'i\rangle/\langle xa, xa\rangle \tag{4}$$

$$xa(n)=xw'(n)-\beta Sa_d(n) \tag{5}$$

where $Sc_i'$ is a perceptually weighted synthesized signal of an excitation codevector $c_i$ of an index i orthogonalized with respect to the perceptually weighted synthesized signal of the selected adaptive codevector, and $\gamma$ is an optimal gain of the excitation codevector.

While a method of orthogonalizing a perceptually weighted synthesized signal of an excitation codevector $c_i$ of an index i with respect to a perceptually weighted synthesized signal of a selected adaptive codevector in order to find simultaneous optimal gains is already known, for example, from reference 1 mentioned hereinabove, the method requires a very large amount of calculation. Thus, such amount of calculation is reduced by calculating an excitation codevector D in the following manner.

First, the equation (4) is substituted into the equation (3):

$$D=\langle xa, xa\rangle-\langle xa, Sc_i'\rangle^2/\langle Sc_i', Sc_i'\rangle \quad (6)$$

Then, the following equation (7) is substituted into the equation (6), and then since xa and $Sa_d$ are orthogonal to each other, the equation (8) is obtained:

$$Sci'=Sc_i-Sa_d\cdot\langle Sa_d, Sc_i\rangle/\langle Sa_d, Sa_d\rangle \quad (7)$$

$$D=\langle xa, xa\rangle-\langle xa, Sc_i\rangle^2/\{\langle Sc_i, Sc_i\rangle-\langle Sa_d, Sc_i\rangle^2/\langle Sa_d, Sa_d\rangle\} \quad (8)$$

Finally, the gain codebook is searched for a gain codevector which minimizes, for the selected adaptive codevector and excitation codevector, the following error E:

$$E=\sum_{n=0}^{N-1}\{xw'(n)-\beta_j Sa_d(n)-\gamma_j Sc_i(n)\}^2 \quad (9)$$

where $(\beta_j, \gamma_j)$ is a gain codevector of an index j.

The gain codebook may be a signal two-dimensional codebook consisting of gains of the adaptive codebook and gains of the excitation codebook or else may consist of two codebooks including a one-dimensional gain codebook consisting of gains of the adaptive codebook and another one-dimensional gain codebook consisting of gains of the excitation codebook.

Thus, the speech coding method is characterized in that, when the excitation codebook is to be searched using an optimal gain as gains of an adaptive codevector and an excitation codevector, the equation (7) is not calculated directly, but the equation (8) based on correlation calculation is used.

Now, if the length of a subframe is N and the excitation codebook has a size of B bits, then the equation (7) requires $N\cdot 2^B$ times of calculating operations because $Sa_d$ is multiplied by $\langle Sa_d, Sc_j\rangle/\langle Sa_d, Sa_d\rangle$, but the equation (8) requires an N times of calculating operations for the calculation of $\langle Sa_d, Sc_j\rangle^2/\langle Sa_d, Sa_d\rangle$. Consequently, calculating operations can be reduced by $N(2^B-1)$ times. Besides, a similarly high sound quality can be attained.

According to another aspect of the present invention, there is provided a speech coding method for coding an input speech signal using a linear predictive analyzer for receiving such input speech signal divided into frames of a fixed interval and finding a spectrum parameter of the input speech signal, an adaptive codebook which makes use of a long-term correlation of the input speech signal, an excitation codebook representing an excitation signal of the input speech signal, and a gain codebook for quantizing a gain of the adaptive codebook and a gain of the excitation codebook, which method comprises at least the step of:

searching the gain codebook for a codevector using a normalization coefficient which is calculated from an autocorrelation of a synthesis signal of an adaptive codevector from the adaptive codebook, a cross-correlation between a synthesis signal of the adaptive codevector and the synthesis signal of the excitation codevector, an autocorrelation of the synthesis signal of the excitation codevector, and an autocorrelation of the input speech signal or an estimated value of such autocorrelation of the input speech signal.

In the speech coding method, the adaptive codebook is searched for an adaptive codevector which minimizes the following error C:

$$C=\sum_{n=0}^{N-1}\{xw'(n)-\beta Sa_d(n)\}^2 \quad (10)$$

for $$\beta=\langle xw', Sa_d\rangle/\langle xw', xw'\rangle \quad (11)$$

where xw' is a signal obtained by subtraction of an influence signal from an input perceptually weighted signal, $Sa_d$ is a perceptually weighted synthesized signal of an adaptive codevector $a_d$ of a delay d, β is an optimal gain of the adaptive codevector, N is a length of a subframe (for example, 5 ms), and <*, *> is an inner product.

Subsequently, the excitation codebook is searched for an excitation codevector which minimizes, for the selected adaptive codevector $a_d$, the following error D:

$$D=\sum_{n=0}^{N-1}\{xa(n)-\gamma Sc_i(n)\}^2 \quad (12)$$

for $$\gamma=\langle xa, Sc'i\rangle/\langle xa, xa\rangle \quad (13)$$

$$xa(n)=xw'(n)-\beta Sa_d(n) \quad (14)$$

where $Sc_i$ is a perceptually weighted synthesized signal of an excitation codevector $c_i$ of an index i, and γ is an optimal gain of the excitation codevector. $Sc_i$ may be a perceptually weighted synthesized signal of an excitation codevector $c_i$ of an index i orthogonalized with respect to a perceptually weighted synthesized signal of the selected adaptive codevector.

Finally, the gain codebook is searched for a gain codevector which minimizes, for the selected adaptive codevector and excitation codevector, the following error E of the equation (15). The gain codebook here need not be a two-dimensional codebook. For example, the gain codebook may consist of two codebooks including a one-dimensional gain codebook for the quantization of gains of the adaptive codebook and another one-dimensional gain codebook for the quantization of gains of the excitation codebook.

$$E=\sum_{n=0}^{N-1}\{xw'(n)-\beta_j Sa_d(n)-\gamma_j Sc_i(n)\}^2 \quad (15)$$

for $$\beta_j=G_{1j}\cdot XRMS/ARMS-\gamma_j\cdot\langle Sa_d, Sc_i\rangle/\langle Sa_d, Sa_d\rangle \quad (16)$$

$$\gamma_j=G_{2j}\cdot XRMS/CRMS \quad (17)$$

$$ARMS=(\langle Sa_d, Sa_d\rangle/N)^{1/2} \quad (18)$$

$$CRMS=\{(Sc_i, sc_i\rangle-\langle Sa_d, Sc_i\rangle^2/\langle Sa_d, Sa_d\rangle)/N\}^{1/2} \quad (19)$$

where XRMS is a quantized RMS of a weighted speech signal for one frame (for example, 20 ms), and $(G_1j, G_2j)$ is a gain codevector of an index j.

While XRMS is a quantized RMS of a weighted speech signal for one frame, a value obtained by interpolation (for example, logarithmic interpolation) into each subframe using a quantized RMS of a weighted speech signal of a preceding frame may be used instead.

The speech coding method is thus characterized in that normalized gains are used as a gain codebook. Since a dispersion of gains is decreased by the normalization, the gain codebook having the normalized gains as codevectors has a superior quantizing characteristic, and as a result, coded speech of a high quality can be obtained.

The above and other objects, features and advantages of the present invention will become apparent from the following description and the appended claims, taken in conjunction with the accompanying drawings in which like parts or elements are denoted by like reference characters.

DESCRIPTION OF THE PREFERRED EMBODIMENTS

Figure 1:
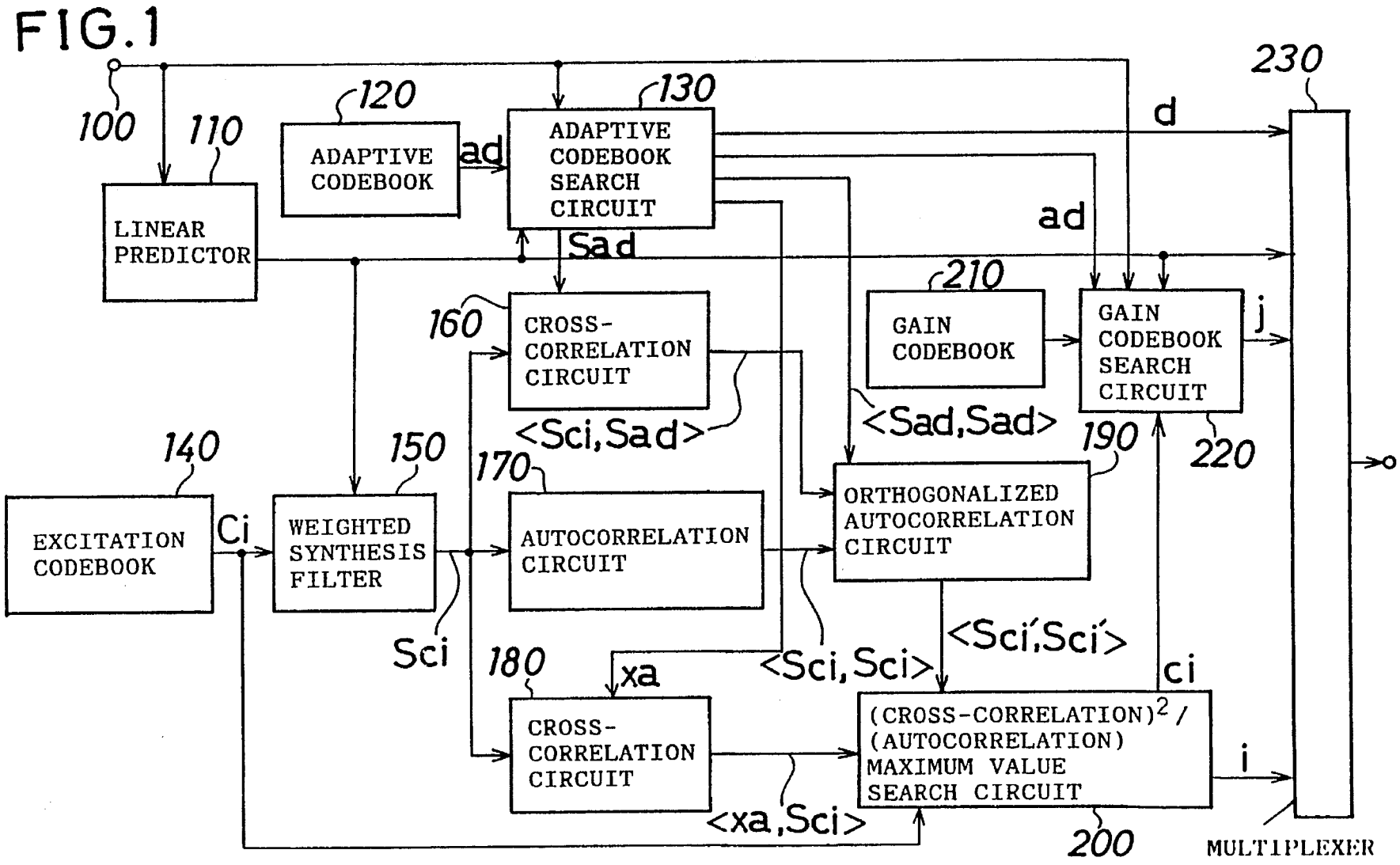
FIG. 1 is a block diagram showing a coder which is used in putting a speech coding method according to the present invention into practice.

Referring first to FIG. 1, there is shown a coder which is used in putting a speech coding method according to the present invention into practice. The coder receives an input speech signal by way of an input terminal 100. The input speech signal is supplied to a linear predictor 110, an adaptive codebook search circuit 130 and a gain codebook search circuit 220. The linear predictor 110 performs a linear predictive analysis of the speech signal divided into frames of a fixed length (for example, 20 ms) and outputs a spectrum parameter to a weighting synthesis filter 150, the adaptive codebook search circuit 130 and the gain codebook search circuit 220. Then, the following processing is performed for each of subframes (for example, 5 ms) into which each frame is further divided.

In particular, adaptive codevectors $a_d$ of delays d are outputted from the adaptive codebook 120 to the adaptive codebook search circuit 130, at which searching for an adaptive codevector is performed. From the adaptive codebook search circuit 130, a selected delay d is outputted to a multiplexer 230; the adaptive codevector $a_d$ of the selected delay d is outputted to the gain codebook search circuit 220; a weighted synthesis signal $Sa_d$ of the adaptive codevector $a_d$ of the selected delay d is outputted to a cross-correlation circuit 160; an autocorrelation $<Sa_d, Sa_d>$ of the weighted synthesis signal $Sa_d$ of the adaptive codevector $a_d$ of the selected delay d is outputted to an orthogonalization cross-correlation circuit 190; and a signal xa obtained by subtraction from the input speech signal of a signal obtained by multiplication of the weighted synthesis signal $Sa_d$ of the adaptive codevector $a_d$ of the selected delay d by an optimal gain $\beta$ is outputted to another cross-correlation circuit 180.

An excitation codebook 140 outputs excitation codevectors $c_i$ of indices 1 to the weighting synthesis filter 150 and a (cross-correlation)$^2$/(autocorrelation) maximum value search circuit 200. The weighting synthesis filter 150 weighted synthesizes the excitation codevectors $c_i$ and outputs them to the cross-correlation circuit 160, an autocorrelation circuit 170 and the cross-correlation circuit 180. The cross-correlation circuit 160 calculates cross-correlations between the weighted synthesis signal $Sa_d$ of the adaptive codevector $a_d$ and weighted synthesis signals $Sc_i$ of the excitation codevector $c_i$ and outputs them to the orthogonalization autocorrelation circuit 190. The autocorrelation circuit 170 calculates autocorrelations of the weighted synthesis signals $Sc_i$ of the excitation codevectors $c_i$ and outputs them to the orthogonalization autocorrelation circuit 190. The cross-correlation circuit 180 calculates cross-correlations between the signal xa and the weighted synthesis signal $Sc_i$ of the excitation codevector $c_i$ and outputs them to the (cross-correlation)$^2$/(autocorrelation) maximum value search circuit 200.

The orthogonalization autocorrelation circuit 190 calculates autocorrelations of weighted synthesis signals $Sc_i'$ of the excitation codevectors $c_i$ which are orthogonalized with respect to the weighted synthesis signal $Sa_d$ of the adaptive codevector $a_d$, and outputs them to the (cross-correlation)$^2$/(autocorrelation) maximum value search circuit 200. The (cross-correlation)$^2$/(autocorrelation) maximum value search circuit 200 searches for an index i with which the (cross-correlation between the signal xa and the weighted synthesis signal $Sc_i'$ of the excitation codevector $c_i$ orthogonalized with respect to the weighted synthesis signal $Sa_d$ of the adaptive codevector $a_d$)$^2$/(autocorrelation of the weighted synthesis signal $Sc_i'$ of the excitation codevector $c_i$ orthogonalized with respect to the weighted synthesis signal $Sa_d$ of the adaptive codevector $a_d$) presents a maximum value, and the index i thus searched out is outputted to the multiplexer 230 while the excitation codevector $c_i$ is outputted to the gain codebook search circuit 220. Gain codevectors of the indices J are outputted from a gain codebook 210 to the Vain codebook search circuit 220. The gain codebook search circuit 220 searches for a gain codevector and outputs the index J of the selected gain codevector to the multiplexer 230.

Figure 2:
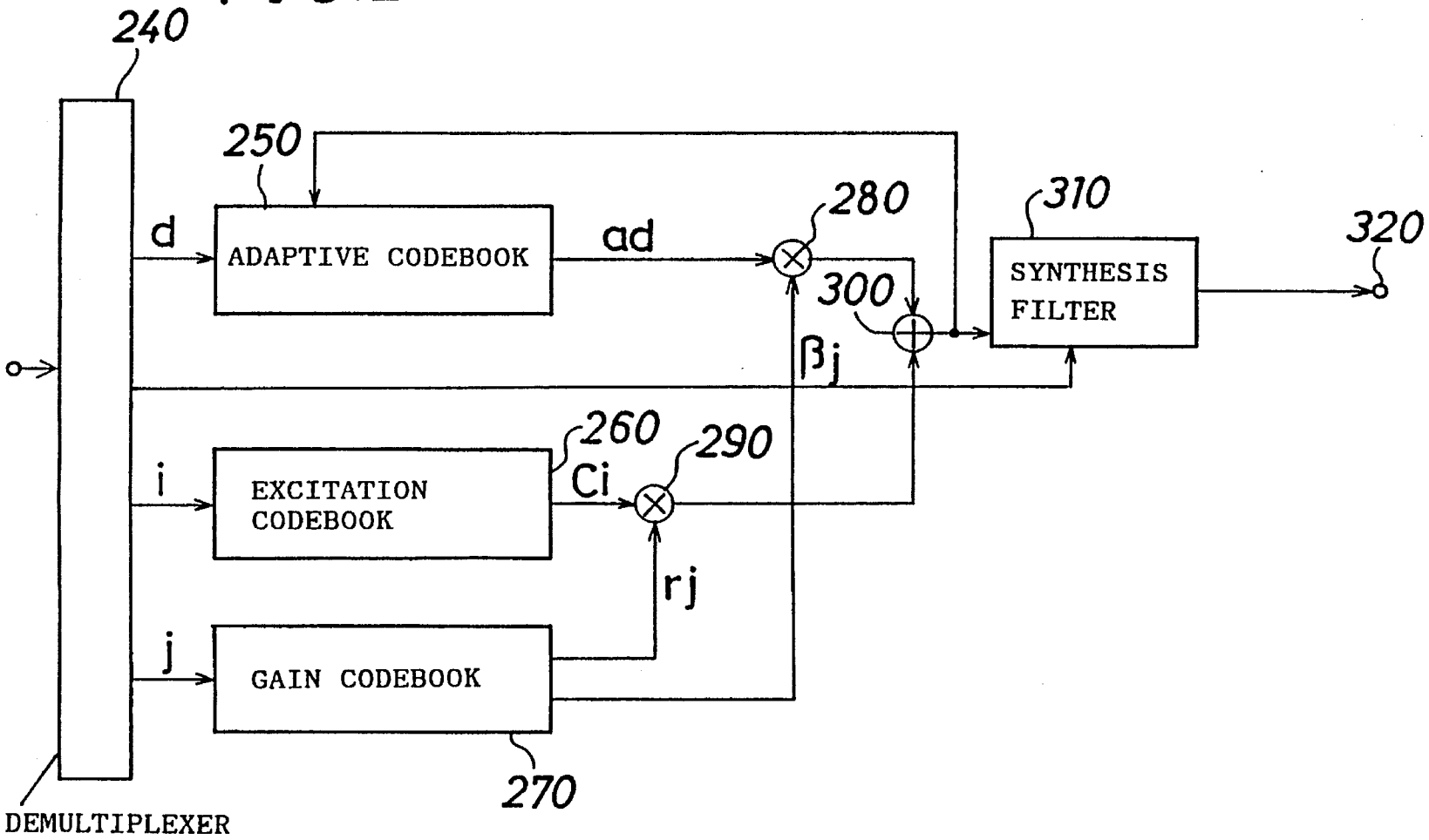
FIG. 2 is a block diagram showing a decoder which is used in putting the speed coding method according to the present invention into practice.

Referring now to FIG. 2, there is shown a decoder which is used in putting the speed coding method according to the present invention into practice. The decoder includes a demultiplexer 240, from which a delay d for an adaptive codebook is outputted to an adaptive codebook 250; a spectrum parameter is outputted to a synthesis filter 310: an index i for an excitation codebook is outputted to an excitation codebook 260; and an index j for a gain codebook is outputted to a gain codebook 270. An adaptive codevector $a_d$ of the delay d is outputted from the adaptive codebook 250; an excitation codevector $c_i$ of the index i is outputted from the excitation codebook 260; and gain codevector$^{r'}(\beta_j, \gamma_j)$ of the index J are outputted from the gain codebook 270. The adaptive codevector $a_d$ and the gain codevector $\beta_j$ are multiplied by a multiplier 280 while the excitation codevector $c_i$ and the gain codevector $\gamma_j$ are multiplied by another multiplier 290, and the two products are added by an adder 300. The sum thus obtained is outputted to the adaptive codebook 250 and the synthesis filter 310. The synthesis filter 310 synthesizes $a_d \cdot \beta_j + c_i \cdot \gamma_j$ and outputs it by way of an output terminal 320.

The gain codebook may be a single two-dimensional codebook consisting of gains for an adaptive codebook and gains for an excitation codebook or may consist of two codebooks including a one-dimensional gain codebook consisting of gains for an adaptive codebook and another one-dimensional gain codebook consisting of gains for an excitation codebook.

When $<xa, Sc_i>$ of the equation (8) given hereinabove is to be calculated by the cross-correlation circuit 180, it may alternatively be calculated in accordance with the following equation in order to reduce the amount of calculation:

$$<xa, Sc_i> = \sum_{k=0}^{N-1} p(k)\, c_i(k) \tag{20}$$

for $$p(k) = \sum_{n=k}^{N-1} xa(n)\, h(n-k) \tag{21}$$

where h is an impulse response of the weighted synthesis filter.

Meanwhile, when $<Sa_d, Sc_i>$ of the equation is to be calculated by the cross-correlation circuit 160, it may alternatively be calculated in accordance with the following equation in order to reduce the amount of calculation:

$$<Sa_d, Sc_i> = \sum_{k=0}^{N-1} q(k)\, c_i(k) \tag{22}$$

for $$q(k) = \sum_{n=k}^{N-1} Sa_d(n)\, h(n-k) \tag{23}$$

On the other hand, when $<Sc_i, Sc_i>$ of the equation (8) is to be calculated by the autocorrelation circuit 170, alternatively it may be calculated approximately in accordance with the following equation in order to reduce the amount of calculation;

$$<Sc_i, Sc_i> = \mu(0)\, \nu(0) + 2 \sum_{m=1}^{N-1} \mu(m)\, \nu(m) \tag{24}$$

for $$\mu(m) = \sum_{n=0}^{N-m-1} h(n)\, h(n+m) \tag{25}$$

$$\nu(m) = \sum_{n=0}^{N-m-1} c(n)\, c(n+m) \tag{26}$$

In the meantime, in order to improve the performance, a combination of a delay and an excitation which minimizes the error between a weighted input signal and a weighted synthesis signal may be found after a plurality of candidates are found for each delay d from within the adaptive codebook and then excitation of the excitation codebook are orthogonalized with respect to the individual candidates. In this instance, when $<Sa_d, Sc_i>$ of the equation (8) is to be calculated by the cross-correlation circuit 160, it may otherwise be calculated in accordance with the following equation (27) in order to reduce the amount of calculation. In this case, however, instead of inputting $Sa_d$ to the cross-correlation circuit 160, xa and an optimal gain β of an adaptive codevector are inputted from the adaptive codebook search circuit 130 and $<xa, Sc_j>$ are inputted from the cross-correlation circuit 180 to the cross-correlation circuit 160.

$$<Sa_d, Sc_i> = (<xw', Sc_i> - <xa, Sc_i>)/\beta \tag{27}$$

The calculation of $<Sa_d, Sc_i>$ in accordance with the equation (27) above eliminates the necessity of calculation of an inner product which is performed otherwise each time the adaptive codebook changes, and consequently, the total amount of calculation can be reduced.

Further, in order to further improve the performance, a combination of a delay of the adaptive codebook and an excitation of the excitation codebook need not be determined decisively for each subframe, but may otherwise be determined such that a plurality of candidates are found for each subframe, and then an accumulated error power is found for the entire frame, whereafter a combination of a delay of the adaptive codebook and an excitation of the excitation codebook which minimizes the accumulate error power is found.

Figure 3:
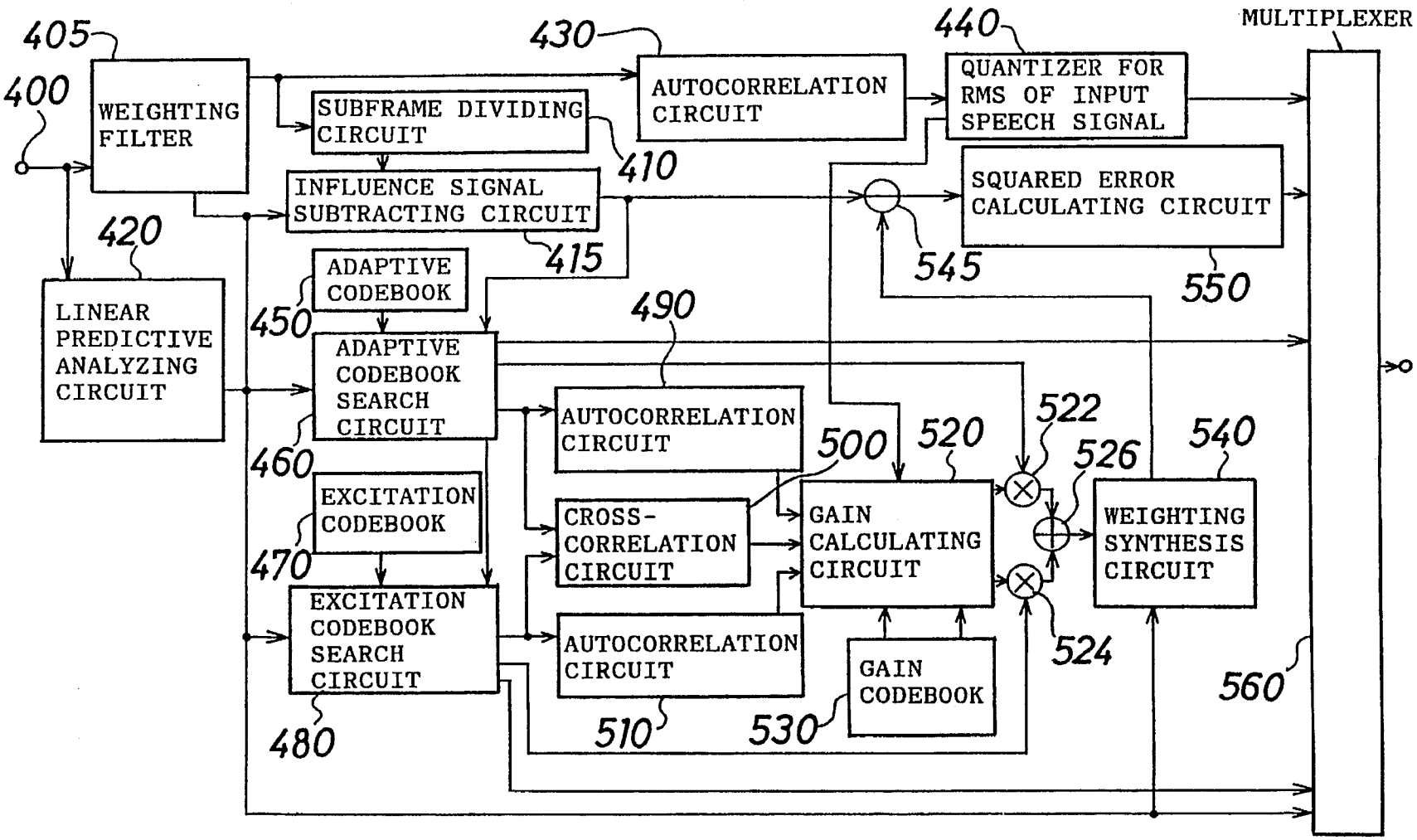
FIG. 3 is a block diagram showing another coder which is used in putting the speed coding method according to the present invention into practice.

Referring now to FIG. 3, there is shown another coder which is used in putting the speech coding method according to the present invention into practice. The coder receives an input speech signal by way of an input terminal 400. The input speech signal is supplied to a weighting filter 405 and a linear predictive analyzer 420. The linear predictive analyzer 420 performs a linear predictive analysis and outputs a spectrum parameter to the weighting filter 405, an influence signal subtracting circuit 415, a weighting synthesis filter 540, an adaptive codebook search circuit 460, an excitation codebook search circuit 480, and a multiplexer 560.

The weighting filter 405 perceptually weights the speech signal and outputs it to a subframe dividing circuit 410 and an autocorrelation circuit 430. The subframe dividing circuit 410 divides the perceptually weighted speech signal from the weighting filter 405 into subframes of a predetermined length (for example, 5 ms) and outputs the weighted speech signal of subframes to the influence signal subtracting circuit 415, at which an influence signal from a preceding subframe is subtracted from the weighted speech signal. The influence signal subtracting circuit 415 thus outputs the weighted speech signal, from which the influence signal has been subtracted, to the adaptive code book search circuit 460 and a subtractor 545. Meanwhile, adaptive codevectors $a_d$ of delays d are outputted from the adaptive codebook 450 to the adaptive codebook search circuit 460, by which the adaptive codebook 450 is searched for an adaptive codevector. From the adaptive codebook search circuit 460, a selected delay d is outputted to the multiplexer 560; the adaptive codevector $a_d$ of the selected delay d is outputted to a multiplier 522; a weighted synthesis signal $Sa_d$ of the adaptive codevector $a_d$ of the selected delay d is outputted to an autocorrelation circuit 490 and a cross-correlation circuit 500; and a signal xa obtained by subtraction from the weighted speech signal of a signal obtained by multiplication of the weighted synthesis signal $Sa_d$ of the adaptive codevector $a_d$ of the selected delay d by an optimal gain β is outputted to the excitation codebook search circuit 480.

The excitation codebook search circuit 480 searches the excitation codebook 470 and outputs an index of a selected excitation codevector to the multiplexer 560, the selected excitation codevector to a multiplier 524, and a weighted synthesis signal of the selected excitation codevector to the cross-correlation circuit 500 and an autocorrelation circuit 510. In this instance, a search may be performed after orthogonalization of the excitation codevector with respect to the adaptive codevector.

The autocorrelation circuit 430 calculates an autocorrelation of the weighted speech signal of the frame length and outputs it to a quantizer for RMS of input speech signal 440. The quantizer for RMS of input speech signal 440 calculates an RMS of the weighted speech signal of the frame length from the autocorrelation of the weighted speech signal of the frame length and μ-law quantizes it, and then outputs the index to the multiplexer 560 and the quantized RMS of input speech signal to a gain calculating circuit 520. The autocorrelation circuit 490 calculates an autocorrelation of the weighted synthesis signal of the adaptive codevector and outputs it to the gain calculating circuit 520. The cross-correlation circuit 500 calculates a cross-correlation between the weighted synthesis signal of the adaptive codevector and the weighted synthesis signal of the excitation codevector and outputs it to the gain calculating circuit 520. The autocorrelation circuit 510 calculates an autocorrelation of the weighted synthesis signal of the excitation codevector and outputs it to the gain calculating circuit 520.

Gain codevectors of the indices J are outputted from a gain codebook 530 to the gain calculating circuit 520, at which gains are calculated. Thus, a gain of the adaptive codevector is outputted from the gain calculating circuit 520 to the multiplier 522 while another gain of the excitation codevector is outputted to the multiplier 524. The multiplier 522 multiples the adaptive codevector from the adaptive codebook search circuit 460 by the gain of the adaptive codevector while the multiplier 524 multiplies the excitation codevector from the excitation codebook search circuit 480 by the gain of the excitation codevector, and the two products are added by an adder 526 and the sum thus obtained is outputted to the weighting synthesis filter 540. The weighting synthesis filter 540 weighted synthesizes the sum signal from the adder 526 and outputs the synthesis signal to the subtractor 545. The subtractor 545 subtracts the output signal of the weighting synthesis filter 540 from the speech signal of the subframe length from the influence signal subtracting circuit 415 and outputs the difference signal to a squared error calculating circuit 550. The squared error calculating circuit 550 searches a gain codevector which minimizes the squared error, and outputs an index of the gain codevector to the multiplexer 560.

When a gain is to be calculated by the gain calculating circuit 520, instead of using a quantized RMS of input speech signal itself, another value may be employed which is obtained by interpolation (for example, logarithmic interpolation) into each subframe using a quantized RMS of input speech signal of a preceding frame and another quantized RMS of input speech signal of a current frame.

Figure 4:
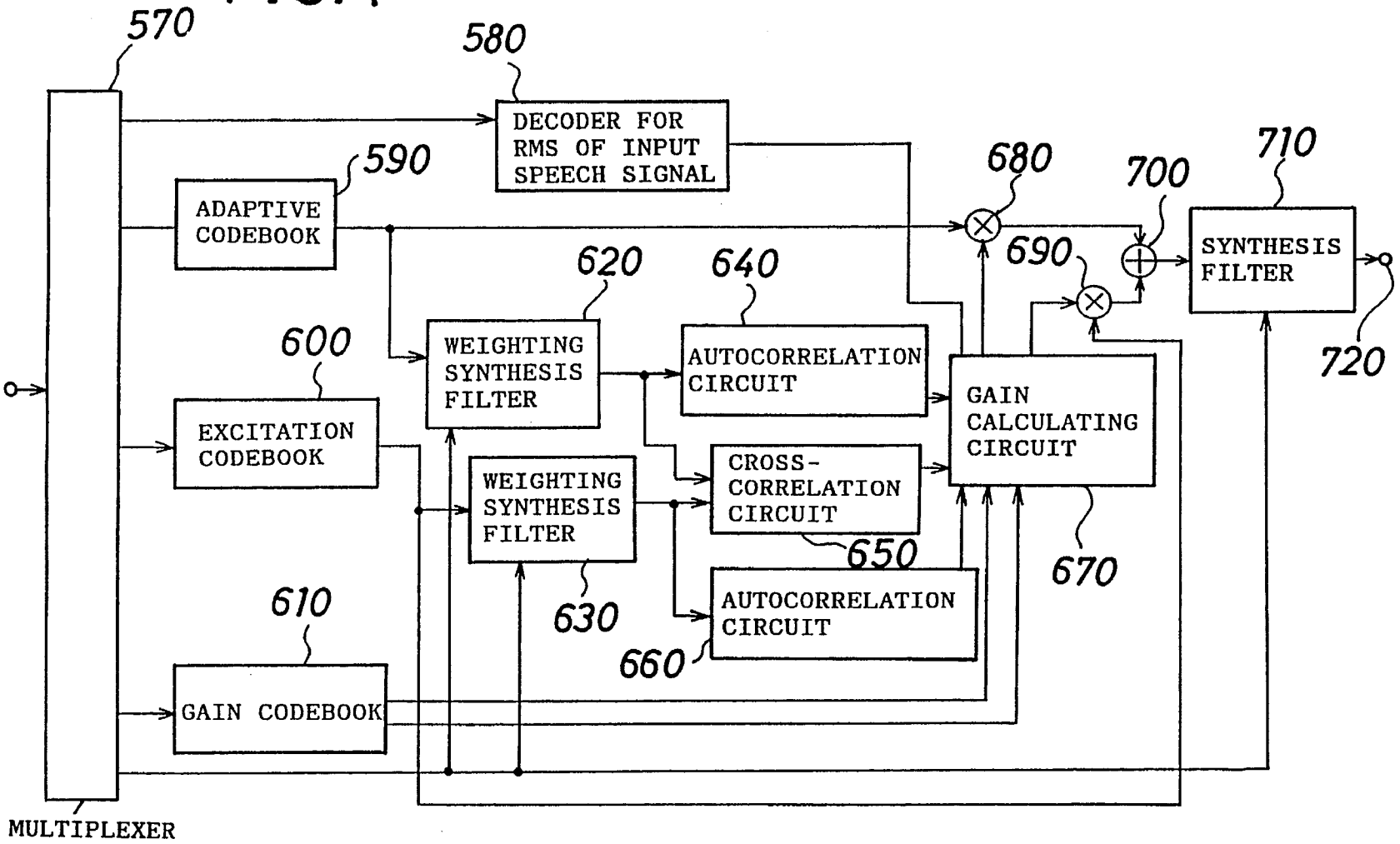
FIG. 4 is a block diagram showing another decoder which is used in putting the speed coding method according to the present invention into practice.

Referring now to FIG. 4, there is shown another decoder which is used in putting the speech coding method according to the present invention into practice. The decoder includes a demultiplexer 570, from which an index of a RMS of input speech signal is outputted to a decoder for RMS of input speech signal 580; a delay of an adaptive codevector is outputted to an adaptive codebook 590; an index to an excitation codevector is outputted to an excitation codebook 600; an index to a gain codevector is outputted to a gain codebook 610; and a spectrum parameter is outputted to a weighting synthesis filter 620, another weighting synthesis filter 630 and a synthesis filter 710.

The RMS of input speech signal is outputted from the decoder for RMS of input speech signal 580 to a gain calculating circuit 670. The adaptive codevector is outputted from the adaptive codebook 590 to the synthesis filter 620 and a multiplier 680. The excitation codevector is outputted from the excitation codebook 600 to the weighting synthesis filter 630 and a multiplier 690. The gain codevector is outputted from the gain codebook 610 to the gain calculating circuit 670. The weighted synthesis signal of the adaptive codevector is outputted from the weighting synthesis filter 620 to an autocorrelation circuit 640 and a cross-correlation circuit 650 while the weighted synthesis signal of the excitation codevector is outputted from the weighting synthetic filter 630 to another autocorrelation circuit 660 and the cross-correlation circuit 650.

The autocorrelation circuit 640 calculates an autocorrelation of the weighted synthesis signal of the adaptive codevector and outputs it to the gain calculating circuit 670. The cross-correlation circuit 650 calculates a cross-correlation between the weighted synthesis signal of the adaptive codevector and the weighted synthesis signal of the excitation codevector and outputs it to the gain calculating circuit 670. The cross-correlation circuit 660 calculates an autocorrelation of the weighted synthesis signal of the excitation codevector and outputs it to the gain calculating circuit 670.

The gain calculating circuit 670 calculates a gain of the adaptive codevector and a gain of the excitation codevector using the equations (16) to (19) given hereinabove and outputs the gain of the adaptive codevector to the multiplier 680 and the gain of the excitation codevector to the multiplier 690. The multiplier 680 multiplies the adaptive codevector from the adaptive codebook 59 by the gain of the adaptive codevector while the multiplier 690 multiplies the excitation codevector from the excitation codebook 600 by the gain of the excitation codevector, and the two products are added by an adder 700 and outputted to the synthesis filter 710. The synthesis filter 710 synthesizes such signal and outputs it by way of an output terminal 720.

When a gain is to be calculated by the gain calculating circuit 670, instead of using a quantized RMS of input speech signal itself, another value may be employed which is obtained by interpolation (for example, logarithmic interpolation) into each subframe using a quantized RMS of input speech signal of a preceding frame and another quantized RMS of input speech signal of a current frame.

Figure 5:
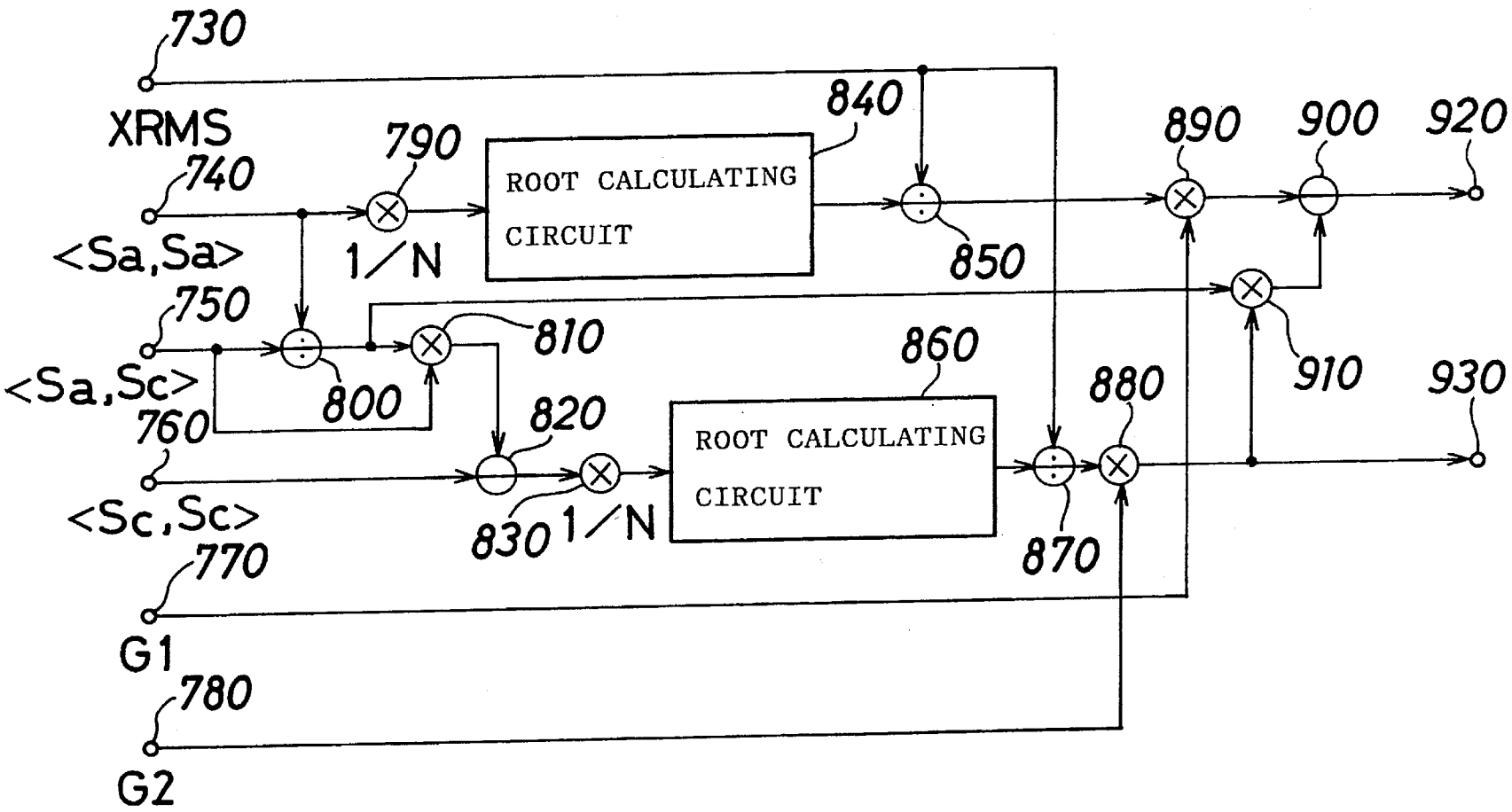
FIG. 5 is a block diagram showing a gain calculating circuit of the decoder shown in FIG. 4.

Referring now to FIG. 5, the gain calculating circuit 670 is shown more in detail. The gain calculating circuit 670 receives a quantized RMS of the input speech signal (hereinafter represented as XRMS) by way of an input terminal 730. The quantized XRMS of the input speech signal is supplied to a pair of dividers 850 and 870. An autocorrelation <Sa, Sa> of a weighted synthesis signal of an adaptive codevector is received by way of another input terminal 740 and supplied to a multiplier 790 and a further divider 800. A cross-correlation <Sa, Sc> between the weighted synthesis signal of the adaptive codevector and a weighted synthesis signal of an excitation codevector is received by way of a further input terminal 750 and supplied to the divider 800 and a multiplier 810. An autocorrelation <Sc, Sc> of the weighted synthesis signal of the excitation codevector is received by way of a still further input terminal 760 and transmitted to a subtractor 820. A first component $G_1$ of a gain codevector is received by way of a yet further input terminal 770 and transmitted to a multiplier 890. A second component $G_2$ of the gain codevector is inputted by way of a yet further input terminal 780 and supplied to a multiplier 880.

The multiplier 790 multiplies the autocorrelation <Sa, Sa> by 1/N and outputs the product to a root calculating circuit 840, which thus calculates a root of <Sa, Sa>/N and outputs it to the divider 850. Here, N is a length of a subframe (for example, 40 samples). The divider 850 divides the quantized XRMS of the input speech signal by (<Sa, Sa>/N)½ and outputs the quotient to the multiplier 890, at which XRMS/(<Sa, Sa>/N)½ is multiplied by the first component $G_1$ of the gain codevector. The product at the multiplier 890 is outputted to the subtractor 900.

The divider 800 divides the cross-correlation <Sa, Sc> by the autocorrelation <Sa, Sa> and outputs the quotient to the multipliers 810 and 910. The multiplier 810 multiplies the quotient <Sa, Sc>/<Sa, Sa> by the cross-correlation <Sa, Sc> and outputs the product to the subtractor 820. The subtractor 820 subtracts $<Sa, Sc>^2/<Sa, Sa>$ from the autocorrelation <Sc, Sc> and outputs the difference to the multiplier 830, at which the difference is multiplied by 1/N. The product is outputted from the multiplier 830 to the root calculating circuit 860. The root calculating circuit 860 calculates a root of the output signal of the multiplier 830 and outputs it to the divider 870. The divider 870 divides the quantized XRMS of the input speech signal from the input terminal 730 by $\{(\langle Sc, Sc\rangle - \langle Sa, Sc\rangle^2/\langle Sa, Sa\rangle)/N\}^{1/2}$ and outputs the quotient to the multiplier 800. The multiplier 880 multiplies the quotient by the second component $G_2$ of the gain codevector and outputs the product to the multiplier 910 and an output terminal 930. The multiplier 910 multiplies the output of the multiplier 880, i.e., $G_2 \cdot XRMS/\{(\langle Sc, Sc\rangle - \langle Sa, Sc\rangle^2/\langle Sa, Sa\rangle)/N\}^{1/2}$, by $\langle Sa, Sc\rangle/\langle Sa, Sa\rangle$ and outputs the product to the subtractor 900. The subtractor 900 subtracts the product from the multiplier 910 from $G_1 \cdot XRMS/(\langle Sa, Sa\rangle/N)^{1/2}$ and outputs the difference to another output terminal 920.

The gain codebook described above need not necessarily be a two-dimensional codebook. For example, the gain codebook may consist of two codebooks including a one-dimensional gain codebook consisting of gains for an adaptive codebook and another one-dimensional gain codebook consisting of gains for an excitation codebook.

The excitation codebook may be constituted from a random number signal as disclosed in reference 3 mentioned hereinabove or may otherwise be constituted by learning in advance using a training data.

Having now fully described the invention, it will be apparent to one of ordinary skill in the art that many changes and modifications can be made thereto without departing from the spirit and scope of the invention as set forth herein.

What is claimed is:

1. A speech coding system for encoding an input speech signal into coded speech sequence, comprising:

a linear predictive analyzer for receiving an input speech signal divided into frames of a fixed interval and finding a spectrum parameter of the input speech signal;

an adaptive codebook representing adaptive code vectors;

an adaptive codebook search circuit for searching said adaptive codebook based on said spectrum parameter and said input speech signal, for selecting a selected adaptive code vector and for outputting the selected adaptive code vector, a selected delay corresponding the selected adaptive code vector, a second synthesis signal synthesized from said selected adaptive code vector and said spectrum parameter, and a difference signal between said input speech signal and the second synthesis signal;

an excitation codebook representing excitation codevectors;

means for generating first synthesis signals by using each of said excitation code vectors and said spectrum parameter;

a first cross-correlation circuit for calculating first cross-correlation between said second synthesis signal and each of said first synthesis signals;

an autocorrelation circuit for calculating autocorrelation of said first synthesis signals;

a second cross-correlation circuit for calculating second cross-correlation between said first synthesis signals and said difference signal;

an orthogonalized autocorrelation circuit for calculating orthogonalized autocorrelation by using said first cross-correlation and said autocorrelation;

searching circuit for calculating normalized values for each of said excitation code vector and determining an excitation code vector index corresponding to a maximum among said normalized values, wherein said normalized values are obtained by using said orthogonalized autocorrelation and said second cross-correlation;

a gain code search circuit for searching said gain codebook based on said input speech signal, said selected adaptive code vector, said spectrum parameter and said excitation code vector index and outputting a gain code vector index;

a multiplexer for multiplexing said selected delay, said spectrum parameter, said gain code vector index and said excitation code vector index and outputting a resultant sequence as said coded speech sequence.

2. A speech coding system for encoding an input speech signal into coded speech sequence, comprising:

a linear predictive analyzer for receiving an input speech signal divided into frames of a fixed interval and finding a spectrum parameter of the input speech signal;

an adaptive codebook representing adaptive code vectors;

an adaptive codebook search circuit for searching said adaptive codebook based on said spectrum parameter and said input speech signal, for selecting a selected adaptive code vector and for outputting the selected adaptive code vector, a selected delay corresponding the selected adaptive code vector, a second synthesis signal synthesized from said selected adaptive code vector and said spectrum parameter, and a difference signal between said input speech signal and the second synthesis signal;

an excitation codebook representing excitation codevectors;

an excitation codebook search circuit for searching said excitation code vectors, for selecting a selected excitation code vector and for outputting an excitation code vector index representing said selected excitation code vector;

means for generating first synthesis signals by using each of said excitation code vectors and said spectrum parameter;

a second autocorrelation circuit for calculating a second autocorrelation of said second synthesis signal;

a cross-correlation circuit for calculating cross-correlation between said second synthesis signal and each of said first synthesis signals;

a first autocorrelation circuit for calculating a first autocorrelation of said first synthesis signal;

a third autocorrelation circuit for calculating a third autocorrelation of said input speech signal;

a gain codebook representing gain code vectors;

a gain calculating circuit for searching a gain codebook based on said first autocorrelation, said second autocorrelation, said third correlation and said cross-correlation and selecting selected gain code vector and for outputting a gain code vector index representing said selected gain code vector;

a multiplexer for multiplexing said selected delay, said spectrum parameter, said gain code vector index and said excitation code vector index and for outputting a resultant sequence as said coded speech sequence.

* * * * *